United States Patent [19]

Bailey

[11] Patent Number: 4,667,914

[45] Date of Patent: May 26, 1987

[54] ADJUSTABLE VALANCE CANOPY BRACKET

[75] Inventor: Stephen P. Bailey, Mississauga, Canada

[73] Assignee: Ontario Store Fixtures Inc., Toronto, Canada

[21] Appl. No.: 746,747

[22] Filed: Jun. 20, 1985

[51] Int. Cl.[4] ..... E04F 10/00

[52] U.S. Cl. ..... 248/286; 248/354.3; 160/38

[58] Field of Search ..... 248/286, 284, 122, 276, 248/274, 242, 354.3; 160/19, 38, 39, 77, 65 A, 81, 22, 72; 52/38, 73, 74; 16/241, 245

[56] References Cited

U.S. PATENT DOCUMENTS

| | | | |
|---|---|---|---|
| 1,102,480 | 7/1914 | Davis | 248/242 |
| 1,319,792 | 10/1919 | Phorson | 248/584 |
| 1,552,432 | 9/1925 | Hescock et al. | 52/73 X |
| 1,791,699 | 2/1931 | Ayersman | 248/276 X |
| 1,806,059 | 5/1931 | Hoople | 248/276 |
| 2,019,473 | 11/1935 | Anton | 248/276 |
| 2,294,998 | 9/1942 | Mitchell | 248/282 |
| 2,443,242 | 6/1948 | Hansen et al. . | |
| 2,739,644 | 3/1956 | Brand | 160/39 |
| 2,915,944 | 12/1959 | Butts . | |
| 3,561,714 | 2/1971 | Zurawski | 160/19 X |
| 3,822,848 | 7/1974 | Hopkins . | |
| 4,074,883 | 2/1978 | Daly et al. | 248/286 |
| 4,590,642 | 5/1986 | Hesener | 160/22 X |

FOREIGN PATENT DOCUMENTS

| | | | |
|---|---|---|---|
| 702825 | 4/1931 | France | 160/81 |

*Primary Examiner*—Ramon S. Britts
*Assistant Examiner*—Karen J. Chotkowski
*Attorney, Agent, or Firm*—Riches, McKenzie & Herbert

[57] ABSTRACT

An adjustable valance canopy bracket to be secured to a wall and support a valance canopy spaced therefrom. The bracket includes a wall engaging plate, a variable length elongate support member and a valance engaging plate. The support member is pivotally coupled to both the wall engaging plate and the valance engaging plate. By varying the angulation of the support member to each of the plates and by varying the length of the support member, the valance may be adjusted to a plurality of positions after the wall engaging plate has been affixed to the wall.

6 Claims, 6 Drawing Figures

ADJUSTABLE VALANCE CANOPY BRACKET

BACKGROUND OF THE INVENTION

This invention relates to a valance canopy bracket and more particularly to an adjustable bracket assembly permitting adjustable location and orientation of a valance allowing for accurate adjustments and variations on all axes regardless of site conditions.

Valances are well known as vertical panels located a distance from a wall below the ceiling.

For example, in a department store, decorative valances are frequently provided above shelves and wall units holding merchandise to provide a pleasing visual appearance to the store and to carry markings, signs and conceal lighting fixtures.

Many existing valances are constructed from wood and other materials which are permanently fixed to the walls against movement. Such known valances suffer the disadvantage that they are difficult and time consuming to construct and erect. For example, rigid brackets which are used to support the valance from the wall may not be able to be located sufficiently accurately on the wall, due to irregularities in floors, walls, and ceilings inherent in most buildings, to provide a level valance in straight runs. This is particularly the case with valances comprised of many modular sections typically of 8 to 12 foot length per section, which when joined together have to create a straight and uniform run of valance around the perimeter of the building interior.

SUMMARY OF THE INVENTION

To overcome these disadvantages the present invention provides a valance system including a wall engaging member to be secured to a wall, a variable length elongate support member pivotally connected to the wall engaging member at one end and pivotally connected at its other end to a valance face member. By means of first locking means releasably locking the support member at a desired angulation with respect to the wall engaging means, and second locking means to releasably lock the valance face member at a desired angulation with respect to the support member, together with suitable locking adjustment of the length of the support member, the position of the valance face member relative to the wall may be readily adjusted.

An object of the present invention is to provide a valance bracket assembly which can be secured to a wall and thereafter readily adjusted to secure the valance at varying heights, at varying distances from the wall and with the valance orientated at different angles with respect to the vertical.

To this end, in one of its aspects, the present invention provides a valance system comprising a valance face member supported, spaced from a wall, by mounting means including at least one adjustable cantilever mounting assembly, the mounting assembly comprising wall engaging means; a first elongate support member coupled at a first end thereto to the first wall engaging means to pivot with respect thereto about a first horizontal axis and extend away from the wall; a second elongate support member coupled to the first support member to be supported by the first support member and slidable longitudinally with respect thereto; the second support member coupled at an end thereof remote from the first support member to the valance face member to permit relative pivoting of said valance face member with respect to the second support member about a second horizontal axis; first locking means releasably locking the first support member against pivoting about the first axis at desired angular orientations with respect to the wall engaging means; second locking means releasably locking the valance face plate against pivoting about the second axis at desired angular orientations with respect to said second support member; and third locking means locking the first and second support members against relative sliding.

BRIEF DESCRIPTION OF THE DRAWINGS

Further objects and advantages will appear from the following description taken together with the accompanying drawings in which.

DETAILED DESCRIPTION OF THE DRAWINGS

Figure 1:
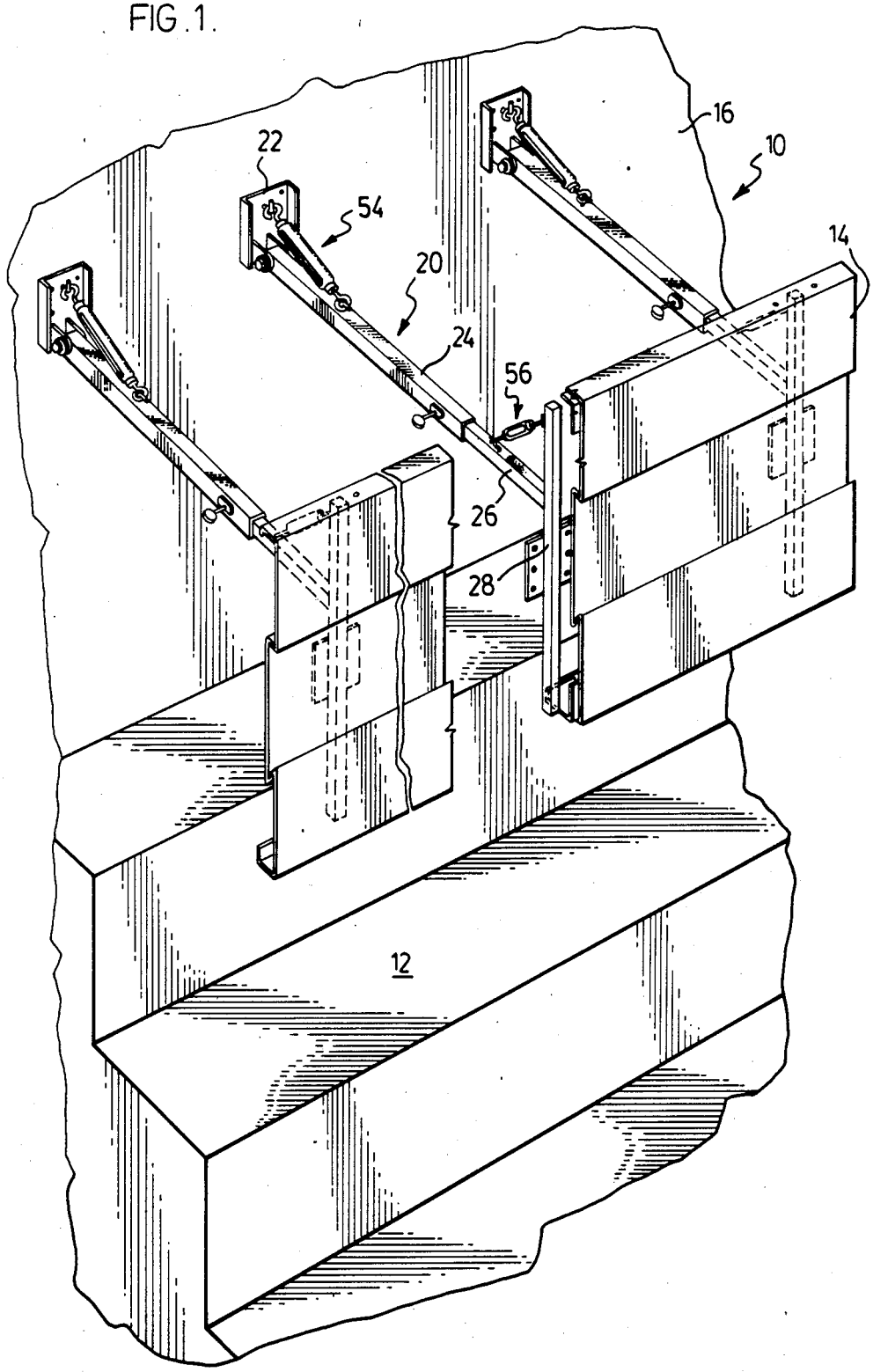
FIG. 1 is a schematic pictorial view of a valance canopy system in accordance with the present invention in the environment of its typical usage extending from a wall above a product display unit.

Reference is made first to FIG. 1 which shows a schematic pictorial view of a valance system generally designated 10 in a typical environment in a retail store suspended over a table 12 to display product on sale. Valance face member 14 is seen supported from wall 16 by a plurality of spaced bracket assemblies generally designated as 20.

Figures 2, 6:
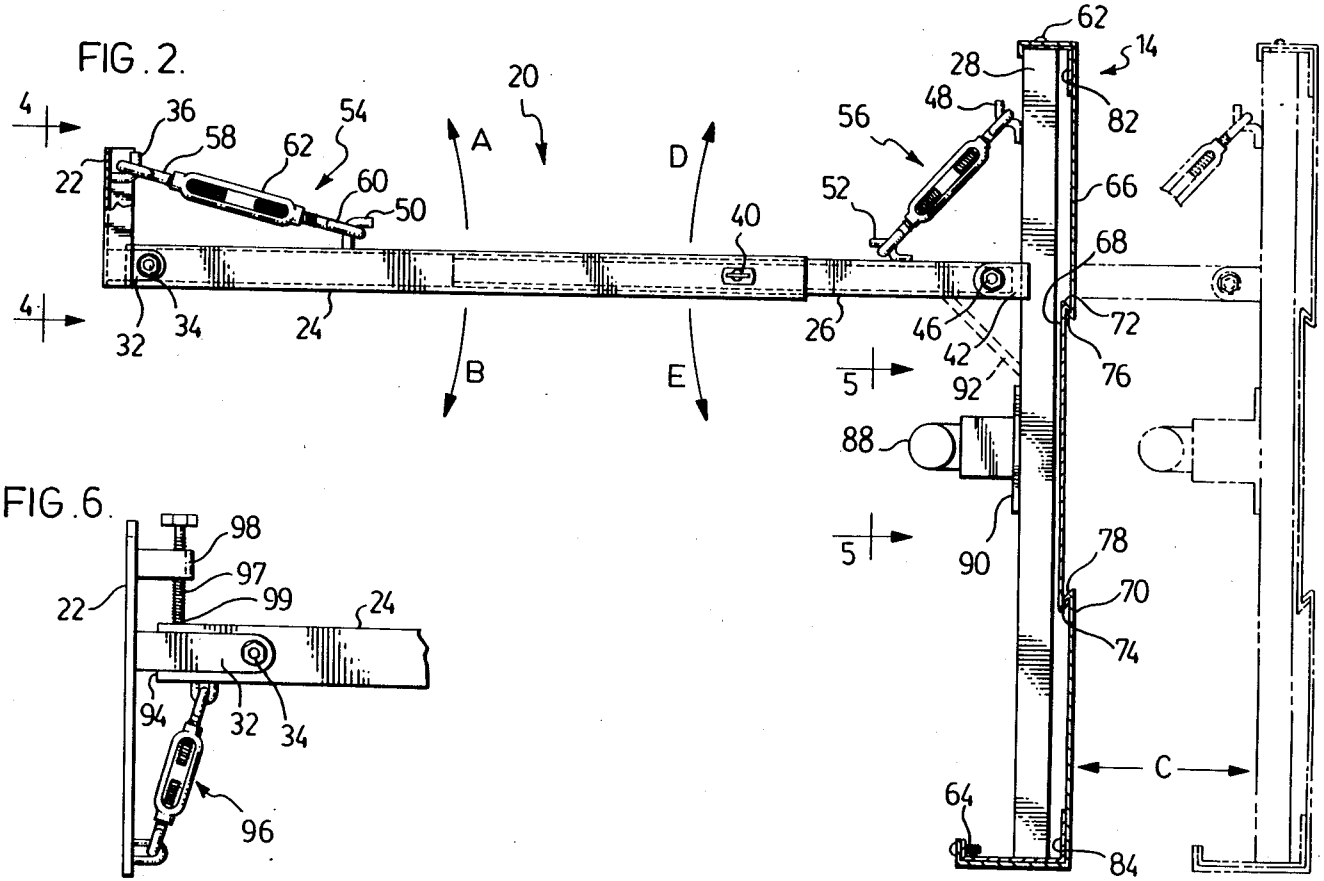
FIGS. 2 and 3 are side and top views respectively of a valence bracket assembly similar to that shown in FIG. 1.
FIG. 6 shows a side view of optional configurations for adjustably coupling support members to wall engaging members.
Figure 3:
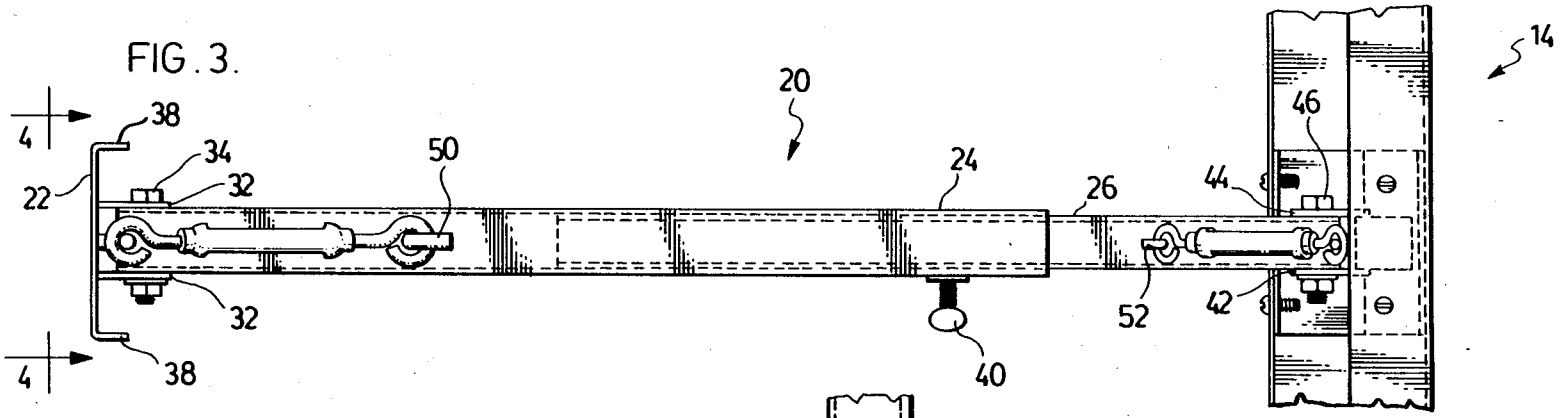
Figure 5:
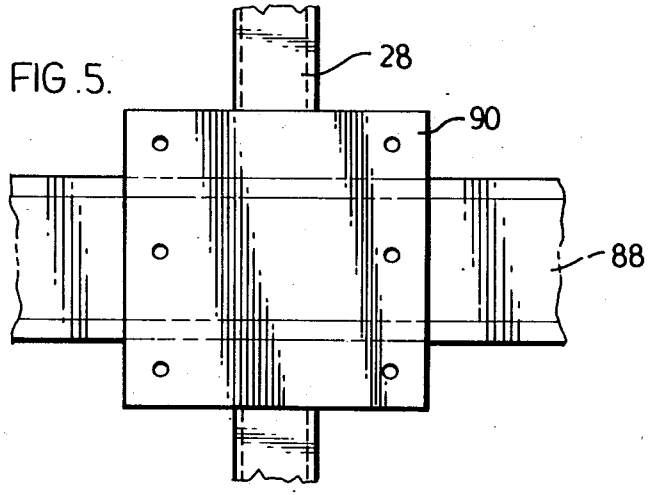
FIG. 5 is a rear end view of a lamp mounting plate shown in FIG. 2.

Reference is now made to FIGS. 2 and 3 showing a preferred embodiment of a valance system similar to that shown in FIG. 1 by which a bracket assembly 20 supports valance face member generally designated 14.

Major components of the bracket assembly include a wall engaging member or plate 22, a first elongate support member 24, a second elongate support member 26, and a valance face engaging member 28.

Plate 22 may be secured to a wall by screws not shown passing through holes 30 in the plate. Plate 22 has ears 32 coupled thereto with a bolt 34 extending horizontally therethrough as well as through a bore in the end of first support member 24 so that first support member 24 may pivot about a first horizontal axis coaxial with bolt 34. A hook 36 is secured to plate 22 above bolt 24. The side edges of plate 22 are bent outwardly as flanges 38 to increase resistance of the plate against bending.

The first and second support members 24 and 26 each comprise hollow tubes of substantially square cross-section. Second support member or tube 26 is closely telescopically received inside first support member or tube 24 so as to be slidably supported therein. A hinged set screw 40 extends through a threaded bore in tube 24 and on tightening contacts tube 26 to lock the tubes against relative sliding.

Valance engaging member 28 is shown as a vertical hollow tube of square cross-section to which two ear-like members 42 and 44 are welded. A bolt 46 passes through the ear-like members and through a bore in the end of tube 26 so that tube 26 may pivot about a second horizontal axis coaxial with bolt 46.

A hook 48 is welded to tube 28 above bolt 46.

Each of the two support tubes are provided with an upwardly directed hook shown as 50 and 52 proximate their relative pivoted ends and spaced from the bolts passing thereto on the side of the bolts remote from the free end of each tube 24 and 26.

Two turnbuckle members 54 and 56 are provided, one connecting hook 36 of plate 22 to hook 50 of tube 24 and the other connecting hook 48 of tube 28 to hook 52 of tube 26. Each turnbuckle member comprises two bolt members 58 and 60 threaded at one end and with an eyelet at the other end to engage one of hooks 36, 48, 50 and 52 and permit, to some extent, pivoting of the bolt members with respect to the hook. One bolt member is threaded with left-hand threads and the other bolt member is threaded with right-hand threads. Central nut member 62 has an axial bore extending therethrough, each threaded with one of left and right handed threads to receive the respectively threaded bolt members 58 or 60. By turning nut member 62 in one direction or the other, the overall length of the turnbuckle member may be increased or decreased.

By varying the length of the turnbuckle member 54, the tube 24 may be pivoted about bolt 34 with respect to plate 22 and the position of tube 24 may be fixed at any desired angular position. Similarly, by varying the length of turnbuckle member 56, tube 28 may be pivoted about bolt 46 with respect to tube 26 and the position of tube 28 may be fixed at a desired angular position.

The valance face member generally designated 14 is coupled to tube 28 as for example by screws 62 and 64.

Operation and use of the valance system is as follows. A plurality of plates 22 are mounted to a wall 16 at positions roughly desired. Once plates 22 have been mounted to the wall, each bracket assembly 20 may be adjusted to carry the valance face member 14 precisely at a desired position. By changing the relative angulation of tubes 24 with respect to plates 22, the height of the valance face member may be varied. By changing the relative angulation of tube 28 with respect to tube 26, the orientation of the face plate member 14 with respect to the vertical may be varied. By sliding tube 26 with respect to tube 24, the distance of the valance face member from the wall may be varied. The turnbuckles 54 and 56 and the set screw 40 permit the bracket assembly to effectively be locked in any position.

Figure 4:
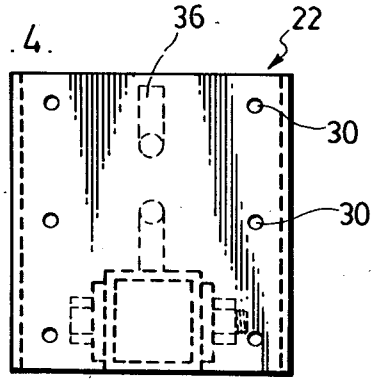
FIG. 4 is a rear end view of the wall engaging plate of FIGS. 2 and 3.

FIGS. 2, 3 and 4 show a useful construction for the valance face member from three separate interconnecting strips of sheet metal, an upper face member 66, a middle face member 68 and a lower face member 70. Middle face member 68 has flanged ends 72 and 74 to be engaged by flange ends 76 and 78 of upper member 66 and lower member 70, respectively. With upper member 66 secured by screw 62 to an upper end cap member 82 on tube 28 and lower member 70 secured by screw 64 to a lower end cap member 86 on tube 28, the middle face member 66 is tensioned and thereby fixedly held in position between the upper and lower face members. With each of the upper, middle and lower face members separable, they may comprise, for example, metal sheeting easily to be painted to be different colours. Alternatively they may comprise plastic of inherently different colour. End cap members 82 and 86 serve the purpose of spacing the upper and lower face members from tube 28 to allow room for the offset in the valance face member caused by the middle face member.

While FIG. 4 shows three cooperating face members, one or more could be provided. The valance face member could comprise but a simple planar member as for example a piece of plywood.

FIG. 2 shows a fluorescent light fixture 88 mounted on the rear of tube 28 as for example on a plate 90 mounted to tube 28.

In FIGS. 1, 2 and 3, the bracket assembly has been shown with valance face engaging means comprising upright tube 28. More simplified valance face engaging means could comprise a plate similar to plate 22 for mounting, for example, to a rigid unitary valance face member. In respect of both the wall engaging member and the valance face engaging member, hooks 36 and 48 have been shown mounted on these members. Optionally such hooks could be independent means mounted directly into the wall or the rear of the valance face member.

In FIGS. 2 and 3, turnbuckles 54 and 56 have been shown as elongate coupling means of adjustable length. Many other coupling means of adjustable length are suitable including for example devices utilizing one threaded bolt member and a swivel joint. Adjustable wire rope and string-like means could also be used.

In the illustrated embodiments, the turnbuckle 54 and 56 are arranged typically to be in tension as for example like strut-like members of adjustable length in tension. Optionally strut-like members such as adjustable length turnbuckles could be structured to resist compression and for example to extend below the support member as in the matter of simplified rod 92 shown in dotted lines in FIG. 2.

FIG. 6 shows two alternate configurations for wall engaging plate 22. In FIG. 6, the wall engaging plate has extended ears 32 so that the bore through which bolt 34 passes through tube 24 is spaced a greater distance from the first end 94 of tube 24. Two alternate locking means are shown in FIG. 6 as means to adjust and lock tube 24 at a desired position. These locking means contact tube 24 spaced from bolt 34 on the side of the bolt between first end 94 of tube 24 and bolt 34. These locking means can comprise a simple turnbuckle shown as 96 below tube 24 in FIG. 6 or as a threaded member 97 received in a vertically threaded protrusion 98 from plate 22 with a head 99 to contact the upper surface of tube 24. Many other suitable adjusting locking means will occur to those skilled in the art including locking means vertically slidable on plate 22 to contact tube 24 at varying longitudinally spaced positions.

In the illustrated embodiments, square tube members 24, 26 and 28 have been shown. Circular tube members could readily be substituted as could side-by-side sliding plates. While cooperating sliding support members are advantageous, in accordance with the present invention these members need merely to provide a support member which has an adjustable length.

The illustrated embodiments show tube 24 constrained against pivoting with respect to plate 22 other than for rotation about bolt 34. Optionally, tube 24 could additionally be provided to pivot about a vertical axis normal to bolt 34. For example, a lockable ball-in-socket type joint could be provided. The coupling shown in FIG. 2 is however satisfactory for most practical purposes and advantageously provides both the bolts 34 and 46 to be orientated substantially parallel to the surface of the wall.

The valance system of FIG. 2 may readily be secured to a wall by plate 22. Thereafter turnbuckle 54 permits rotation of support members 24 and 26 with respect to plate 22 about bolt 34 as indicated by arrows A and B. Relative sliding of support members 24 and 26 permits movement of member 26 and valance face member 14 from the solid position to the dotted position as shown by Arrow C in FIG. 2. Turnbuckle 56 permits rotation of valance face member 14 about bolt 46 with respect to support member 26 as indicated by Arrows D and E in FIG. 2.

Although the disclosure describes and illustrates preferred embodiments of the invention, it is to be understood that the invention is not limited to these particular embodiments. Many variations and modifications will occur to a person skilled in the art. For a definition of the invention, reference is made to the appended claims.

What I claim is:

1. A valance system comprising a valance face member supported spaced from a wall by a plurality of adjustable cantilever mounting assemblies, each mounting assembly comprising:

(a) wall engaging means;

(b) a first elongate support member coupled at a first end thereof to said wall engaging means to pivotable with respect thereto about a first horizontal axis and extending away from the wall;

(c) a second elongate support member coupled to said first support member, supported by the first support member and slidable longitudinally with respect thereto; said second support member coupled at an end thereof remote from said first support member to said valance face member permitting relative pivoting of said valance face member with respect to said second support member about a second horizontal axis parallel to said first horizontal axis; the second support member slidable with respect to the first support member to vary, in a non-stepwise manner, the resultant length of the coupled first and second support members, (d) first elongate strut means of adjustable length pivotally coupled at one end to said wall engaging means and pivotally coupled at the other end to said first support member whereby varying the length of said first strut means pivots said first support member with respect to said wall engaging means about said first axis and wherein with the first strut means adjusted to any desired length the first strut means supports the first support member against pivoting about said first axis at a corresponding angular orientation with respect to said wall engaging means;

(e) second elongate strut means of adjustable length pivotally coupled at one end to said valance face member and pivotally coupled at the other end to said second member whereby varying the length of said second strut means pivots said valance face member with respect to said second support member and wherein with the second strut means adjusted to any desired length the second strut means supports the valance face member at a corresponding angular orientation with respect to said wall engaging means.

2. The valance system claimed in claim 1 wherein said valance face member has a decorative front surface and a rear surface, said remote end of the second support member coupled to said rear surface.

3. The valance system claimed in claim 1 wherein said first elongate strut means is coupled at one end to said wall engaging means above said first axis and at the other end to said first support member at a location spaced from said first axis on the side thereof remote from said first end.

4. The valance system claimed in claim 1 wherein said second elongate strut means is coupled at one end to said valance face member above said second axis and at the other end to said second support member at a location spaced from said second axis on a side thereof remote from said remote end.

5. The valance system claimed in claim 3 wherein said second elongate strut means is coupled at one end to said valance face member above said second axis and at the other end to said second support member at a location spaced from said second axis on a side thereof remote from said remote end.

6. The valance system of claim 5 wherein said first and second strut means comprise turnbuckle-like means.

* * * * *